US010729247B2

(12) United States Patent
Ni et al.

(10) Patent No.: US 10,729,247 B2
(45) Date of Patent: Aug. 4, 2020

(54) RESETTABLE PRESSURE BAR MODULE

(71) Applicants: Pei-Yao Ni, Tainan (TW); Chiu-Yu Su, Tainan (TW); Hsin-Cheng Chen, Tainan (TW)

(72) Inventors: Pei-Yao Ni, Tainan (TW); Chiu-Yu Su, Tainan (TW); Hsin-Cheng Chen, Tainan (TW)

( * ) Notice: Subject to any disclaimer, the term of this patent is extended or adjusted under 35 U.S.C. 154(b) by 146 days.

(21) Appl. No.: 15/893,814

(22) Filed: Feb. 12, 2018

(65) Prior Publication Data

US 2018/0338618 A1 Nov. 29, 2018

(30) Foreign Application Priority Data

May 26, 2017 (TW) ..... 106117583 A

(51) Int. Cl.

| | |
|---|---|
| ***A47C 3/18*** | (2006.01) |
| ***F15B 15/14*** | (2006.01) |
| ***A47C 3/30*** | (2006.01) |
| ***F15B 15/20*** | (2006.01) |

(52) U.S. Cl.

CPC ..... *A47C 3/185* (2013.01); *A47C 3/30* (2013.01); *F15B 15/149* (2013.01); *F15B 15/1447* (2013.01); *F15B 15/202* (2013.01)

(58) Field of Classification Search

CPC ..... A47C 3/185; F15B 15/1466; F15B 15/149
See application file for complete search history.

(56) References Cited

U.S. PATENT DOCUMENTS

| | | | | | |
|---|---|---|---|---|---|
| 1,386,621 | A * | 8/1921 | Hughes | E05F 1/065 | 16/284 |
| 1,808,901 | A * | 6/1931 | McGerry | A47C 3/18 | 16/303 |
| 2,351,194 | A * | 6/1944 | Herman | A47C 3/18 | 248/417 |
| 2,755,842 | A * | 7/1956 | Caramelli | A47C 3/18 | 248/416 |
| 3,207,464 | A * | 9/1965 | Hrach | A47C 3/18 | 248/417 |
| 3,223,376 | A * | 12/1965 | Ciuffini | A47C 3/18 | 248/417 |
| 3,385,550 | A * | 5/1968 | Doerner | A47C 3/24 | 248/417 |

(Continued)

FOREIGN PATENT DOCUMENTS

TW M323844 U 12/2007

*Primary Examiner* — Thomas E Lazo
*Assistant Examiner* — Matthew Wiblin
(74) *Attorney, Agent, or Firm* — Alan D. Kamrath; Karin L. Williams; Mayer & Williams PC

(57) ABSTRACT

A resettable pressure bar module includes a pressure bar, a rotation element, and a resetting element. The pressure bar includes an outer tube, an upper sealing element, and a lower sealing element. The upper sealing element and the lower sealing element are disposed in the outer tube and respectively disposed on the opposite two sides of the outer tube. The rotation element is fixed to the outer tube and the lower sealing element through a fixing element. One side of the resetting element includes a first guiding slope and a second guiding slope. The pressure bar passes through the resetting element. The rotation element is configured to rotate to a normal position along the first guiding slope or the second guiding slope.

5 Claims, 12 Drawing Sheets

(56) References Cited

U.S. PATENT DOCUMENTS

| | | | | | |
|---|---|---|---|---|---|
| 3,837,611 | A * | 9/1974 | Rhoades | A47C 3/18 | 248/417 |
| 5,265,838 | A * | 11/1993 | Kjellman | A47C 3/185 | 248/289.31 |
| 6,315,262 | B1 * | 11/2001 | Hur | A47C 3/18 | 248/162.1 |
| 2015/0034790 | A1 * | 2/2015 | Tsuboi | A47C 3/185 | 248/404 |
| 2017/0318967 | A1 * | 11/2017 | Kjellman | A47C 3/185 | |

* cited by examiner

RESETTABLE PRESSURE BAR MODULE

BACKGROUND OF THE INVENTION

1. Field of the Invention

This invention relates to a pressure bar module and, in particular, to a resettable pressure bar module.

2. Description of the Related Art

Lifting chairs are commonly used elements in the living life, such as at the house, office, entertainment place and factory. There are many operation methods for the lifting chair. For example, using an operation bar and the weight can make the chair cushion of the chair go down, and using the operation bar and the decrement of the weight can make the chair cushion go up to a required height position. For another lifting chair, otherwise, there is no need to use the operation bar but the chair cushion immediately goes up to the highest position when the user just leaves the chair cushion.

However, the usage still needs some improvement. For example, in some formal occasions the alignment of the lifting chairs is very important. But, the users on the lifting chairs may randomly rotate the chairs so the all lifting chairs will face different orientations even though they have the same height position when the users leave the chairs. In this case, the all chairs need to be aligned towards the same orientation manually, increasing the workers' burden.

Therefore, it is an important subject to provide a resettable pressure bar module which can be applied to a lifting chair and can make the all lifting chairs with the resettable pressure bar module face the same orientation through an automatic resetting process when the users leave the chairs, so as to enhance the efficiency of the usage.

BRIEF SUMMARY OF THE INVENTION

In view of the foregoing, an objective of the invention is to provide a resettable pressure bar module which can be applied to a lifting chair and can make the all lifting chairs face the same orientation through an automatic resetting process when the users leave the chairs.

To achieve the above objective, a resettable pressure bar module according to this invention includes a pressure bar, a rotation element and a resetting element. The pressure bar includes an outer tube, an upper sealing element and a lower sealing element. The upper sealing element and the lower sealing element are disposed in the outer tube and respectively disposed on the opposite two sides of the outer tube. The rotation element is fixed to the outer tube and the lower sealing element through a fixing element. One side of the resetting element includes a first guiding slope and a second guiding slope. The pressure bar passes through the resetting element. The rotation element is configured to rotate to a normal position along the first guiding slope or the second guiding slope.

In one embodiment, a recess is disposed between the first guiding slope and the second guiding slope, and the normal position is located at the recess.

In one embodiment, the first guiding slope and the second guiding slope are connected to each other, and the normal position is located at the intersection between the first guiding slope and the second guiding slope.

In one embodiment, the resetting element includes a vibration reducing portion located between the first guiding slope and the second guiding slope, and the normal position is located at the vibration reducing portion.

In one embodiment, the vibration reducing portion includes two slopes connecting to each other, and the slopes are connected to the first guiding slope and the second guiding slope, respectively.

In one embodiment, the resetting element includes a guiding element and a vibration reducing element, the guiding element includes the first guiding slope and the second guiding slope, and the vibration reducing element includes the vibration reducing portion and is connected to the guiding element.

In one embodiment, the guiding element includes a recess, and the vibration reducing element is inserted into the recess to connect to the guiding element.

In one embodiment, the pressure bar further includes a piston disposed in the outer tube and defining an upper chamber and a lower chamber. The upper chamber is disposed near the upper sealing element, and the lower chamber is disposed near the lower sealing element. A valve base is disposed in the outer tube and fixed to the upper sealing element. An inner tube is disposed in the outer tube and fixed between the valve base and the lower sealing element. A push bar is disposed in the outer tube, passes through the upper sealing element and is exposed from the outer tube. An operation bar passes through the valve base and contacts the push bar.

In one embodiment, the valve base includes a first valve hole, the lower sealing element includes a second valve hole, the piston includes an inner channel and a sealing ring which is able to open and close an upper opening of the inner channel, and an outer channel forms between the outer tube and the inner tube.

In one embodiment, when the resettable pressure bar module is under a first operation, an air flows from the upper chamber to the lower chamber sequentially through the first valve hole, the outer channel and the second valve hole, and when the resettable pressure bar module is under a second operation, the air flows from the lower chamber to the upper chamber through the inner channel.

As mentioned above, a resettable pressure bar module according to the invention is configured with a rotation element and a resetting element. The rotation element is fixed to the outer tube of the pressure bar and the lower sealing element through a fixing element, and the resetting element at one side includes a first guiding slope and a second guiding slope. Thereby, in the case of that the resettable pressure bar module descends (the outer tube descends in relation to the piston bar) and rotates due to the user's operation, when the resettable pressure bar module ascends (the outer tube ascends in relation to the piston bar) again, the rotation element can contact the resetting element again and can be rotated to a normal position along the first guiding slope or the second guiding slope. Therefore, all the lifting devices using the resettable pressure bar module of the invention can be located at the normal position and aligned towards the same orientation for increasing the using efficiency, and the assembly and the process are facilitated.

Moreover, in this invention, the vibration reducing portion is disposed or the first guiding slope and the second guiding slope are directly connected with each other to form a vibration reducing portion. Therefore, when the rotation element rotates to the normal position along the first guiding slope or the second guiding slope, the whole vibration and waver can be reduced by the vibration reducing portion to enhance the using efficiency and the product competitiveness.

The present invention will become clearer in light of the following detailed description of illustrative embodiments of this invention described in connection with the drawings, wherein the same references relate to the same elements.

DESCRIPTION OF THE DRAWINGS

The illustrative embodiments of this invention may best be described by reference to the accompanying drawings where.

DETAILED DESCRIPTION OF THE INVENTION

Figure 1:
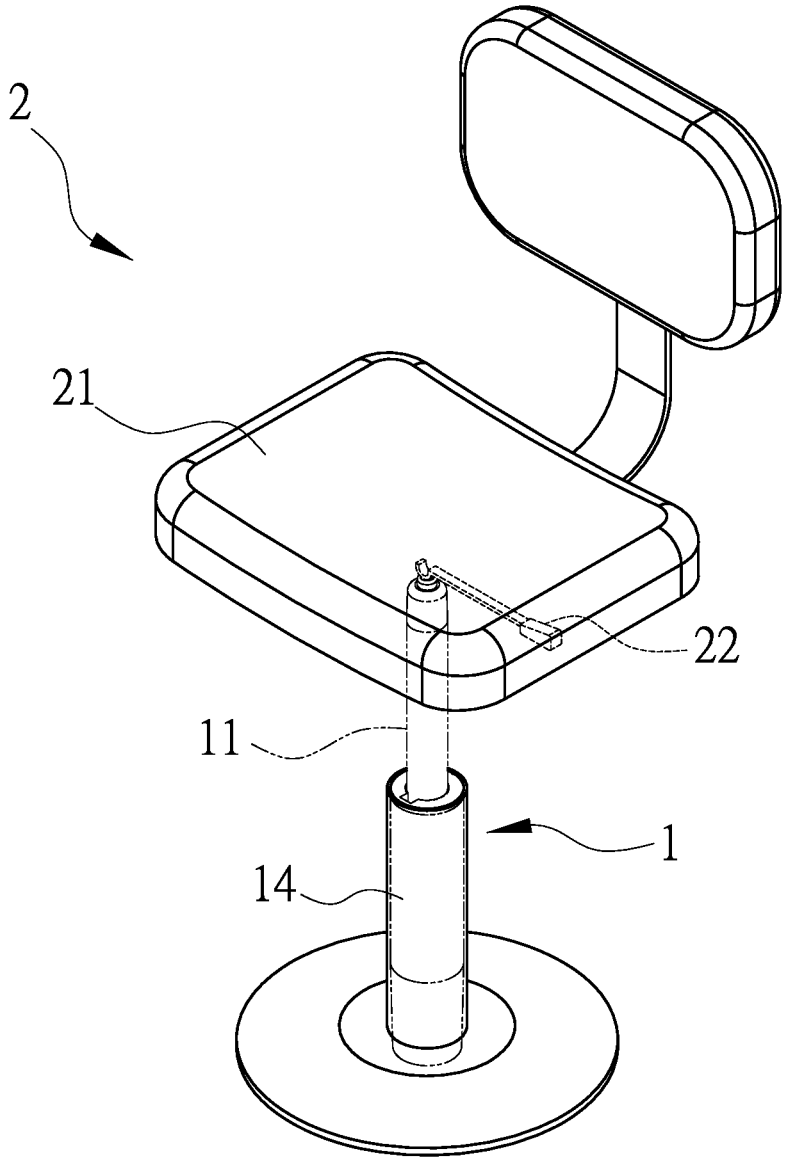
FIG. 1 is a schematic diagram of the resettable pressure bar module of an embodiment of the invention applied to a lifting chair.

FIG. 1 is a schematic diagram of the resettable pressure bar module 1 of an embodiment of the invention applied to a lifting chair 2. To be noted, FIG. 1 is just for illustrating an application of the resettable pressure bar module 1 but not for limiting the scope of the invention. In other words, the resettable pressure bar module 1 of this embodiment can be applied to other lifting devices. As shown in FIG. 1, when the resettable pressure bar module 1 is applied to the lifting chair 2, a pressure bar 11 is fixed to the underneath of a chair cushion 21 of the lifting chair 2 and an operation bar 22 can be connected with the pressure bar 11 for the user's operation. The user can control the rise and fall of the chair cushion 21 of the lifting chair 2 by operating the operation bar 22.

Figure 2:
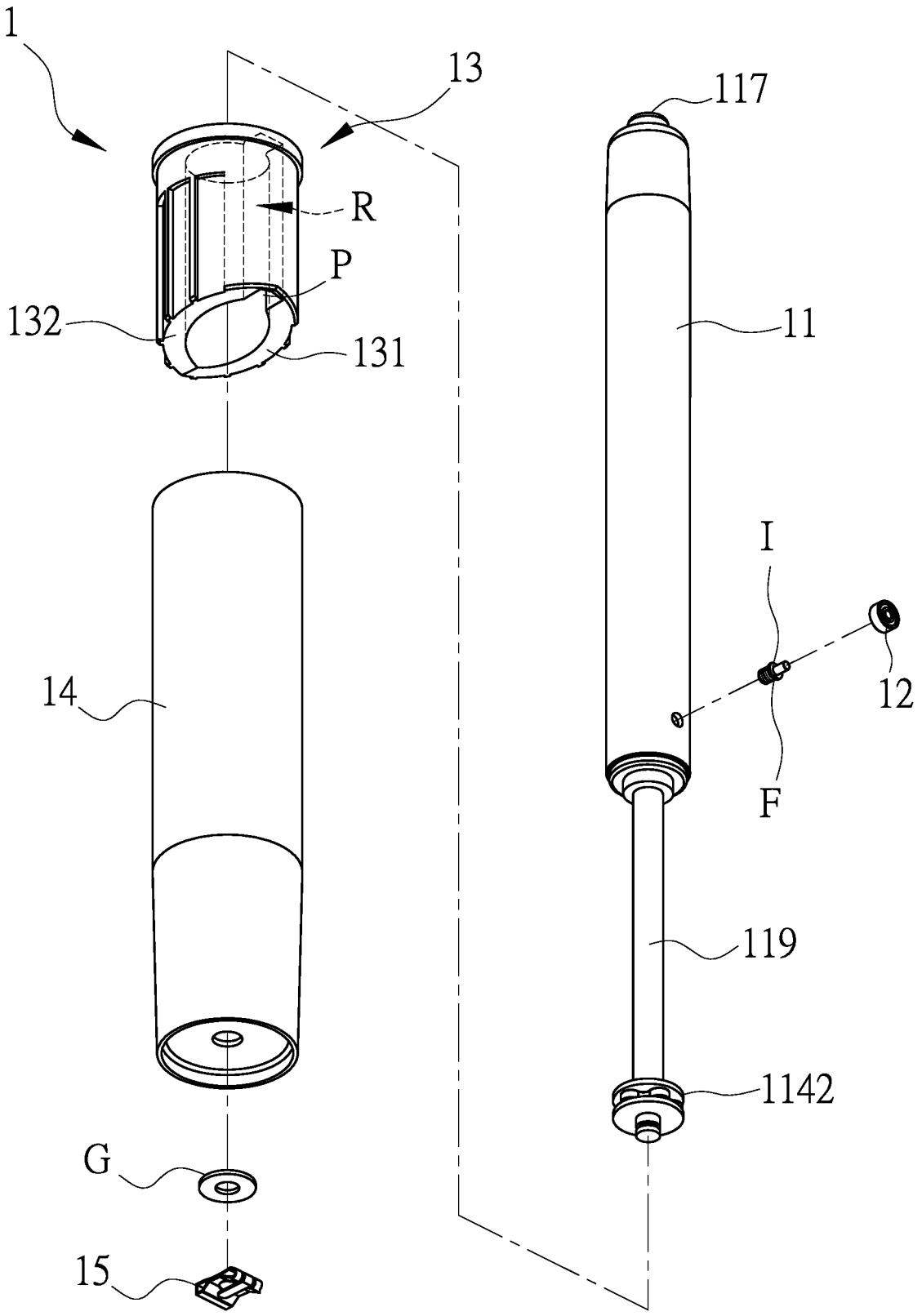
FIG. 2 is a schematic exploded diagram of the resettable pressure bar module of an embodiment of the invention.
Figure 3:
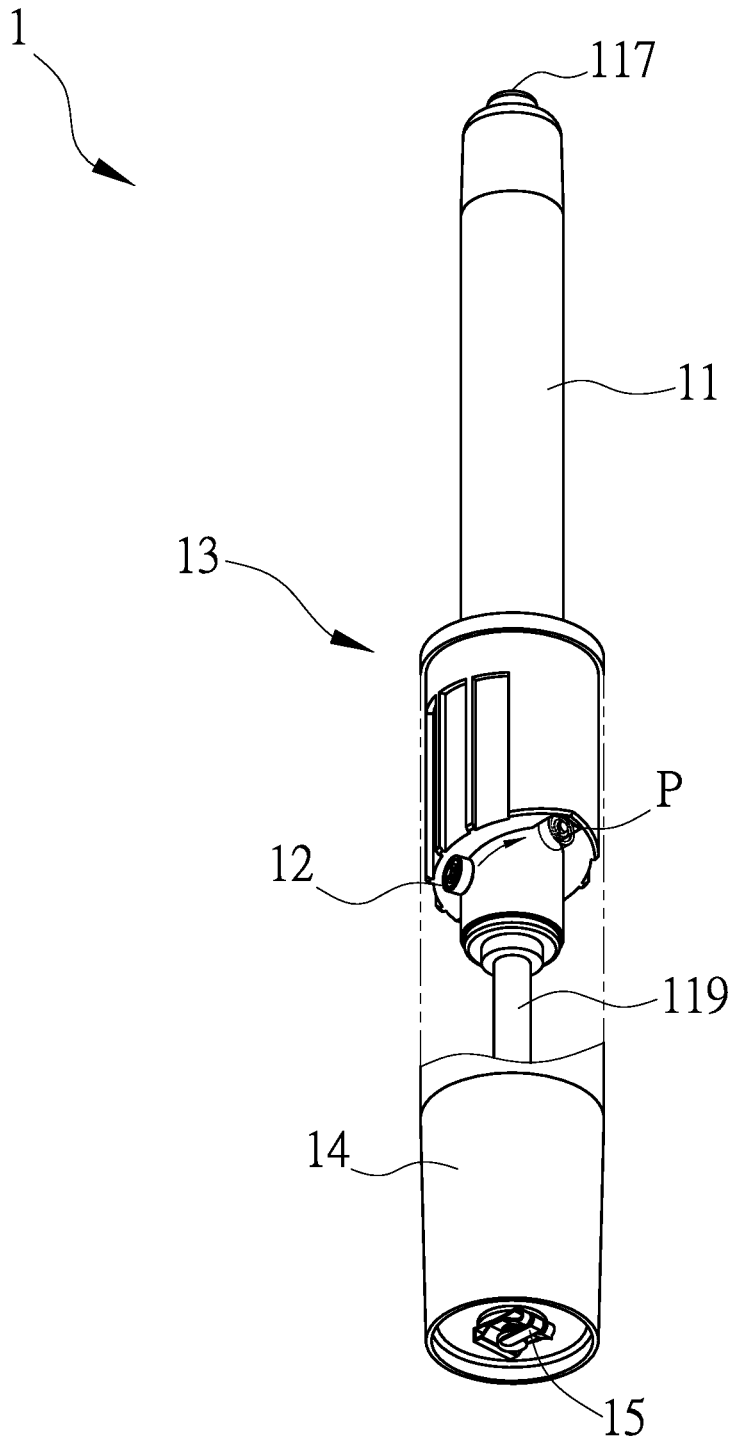
FIG. 3 is a schematic perspective diagram of the resettable pressure bar module of an embodiment of the invention, wherein a part of the resettable pressure bar module is revealed.
Figure 4:
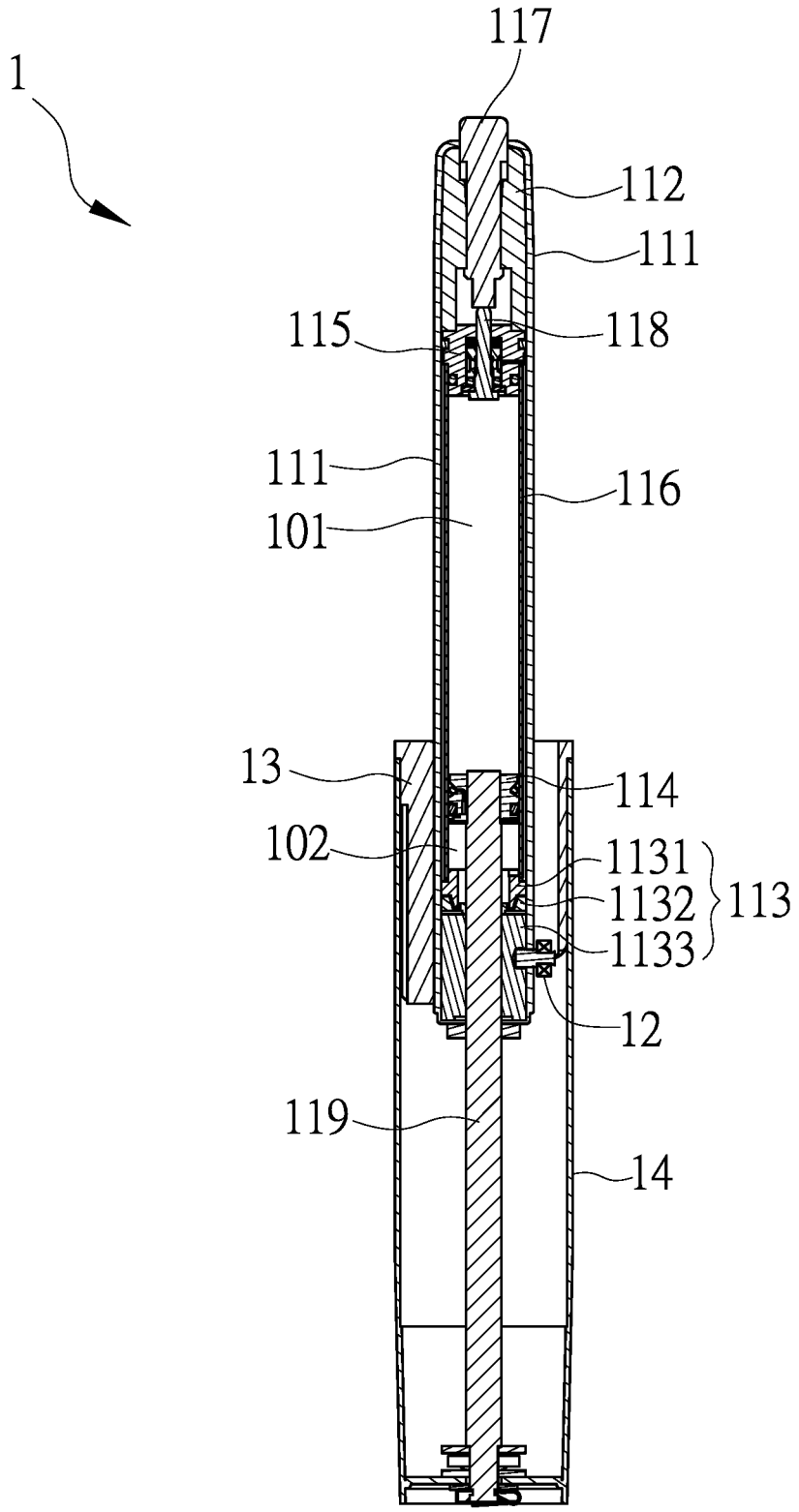
FIG. 4 is a schematic sectional diagram of the resettable pressure bar module of an embodiment of the invention.

FIG. 2 is a schematic exploded diagram of the resettable pressure bar module 1, FIG. 3 is a schematic perspective diagram of the resettable pressure bar module 1 wherein a part of the resettable pressure bar module 1 is revealed, and FIG. 4 is a schematic sectional diagram of the resettable pressure bar module 1. As shown in FIGS. 2-4, the resettable pressure bar module 1 of this embodiment includes a pressure bar 11, a rotation element 12, and a resetting element 13.

In this embodiment, the pressure bar 11 includes an outer tube 111, an upper sealing element 112, and a lower sealing element 113. The upper sealing element 112 and the lower sealing element 113 are disposed in the outer tube 111 and respectively disposed on the opposite two sides of the outer tube 111. The lower sealing element 113 of this embodiment includes a bearing 1131, an oil sealant 1132, and an oil sealant base 1133. The oil sealant 1132 is disposed between the bearing 1131 and the oil sealant base 1133, and they are fixed together.

The pressure bar 11 of this embodiment further includes a piston 114, a valve base 115, an inner tube 116, a push bar 117, and an operation bar 118. The piston 114 is disposed within the outer tube 111 and defines an upper chamber 101 and a lower chamber 102 for the gas infusion. The upper chamber 101 is disposed near the upper sealing element 112 and the lower chamber 102 is disposed near the lower sealing element 113. The valve base 115 is disposed within the outer tube 111 and fixed to the upper sealing element 112. Herein, the upper chamber 101 is disposed between the valve base 115 and the piston 114. The inner tube 116 is disposed within the outer tube 111, and one end of the inner tube 116 is fixed to the valve base 115 while the other end thereof is fixed to the lower sealing element 113, for example, to the bearing 1131 of the lower sealing element 113. The push bar 117 is disposed in the outer tube 111 and passes through the upper sealing element 112 to be exposed from the outer tube 111. Herein, the push bar 117 can be connected with the operation bar 22 shown as FIG. 1. The operation bar 118 passes through the valve base 115 and is disposed against the push bar 117. By the operation of the operation bar 118, the valve base 115 can be opened or closed to control the flow of the air. Moreover, the pressure bar 11 further includes a piston bar 119, which passes through the lower sealing element 113 and is fixed to the piston 114. One end of the piston bar 119 far from the piston 114 is configured with a bearing 1142.

The rotation element 12 is a rolling bearing for example, and can be fixed to the outer tube 111 and the lower sealing element 113 by a fixing element F. The fixing element F is a screw for example. One side of the screw can be connected with the lower sealing element 113, for example the oil sealing base 1133, through a thread, and the other side thereof can be connected with the rotation element 12. In this embodiment, the portion of the lower sealing element 113 to which the fixing element F is fixed is the oil sealing base 1133, which can be made of metal material (such as aluminum alloy) for enhancing the connection strength between the fixing element F and the oil sealing base 1133. In this embodiment, the thickness of the oil sealing base 1133 is increased from 10 mm to 30 mm for example, for further enhancing the connection strength. Moreover, in this embodiment, the fixing element F further includes an separation portion I separating the outer tube 111 from the rotation 12, so as to prevent the rotation element 12 from contacting and rubbing the outer tube 111 during the rotation of the rotation element 12.

The resetting element 13 at one side includes a first guiding slope 131 and a second guiding slope 132. The pressure bar 11 passes through the resetting element 13, and the rotation element 12 is configured to rotate to a normal position P along the first guiding slope 131 or the second guiding slope 132. Herein, a recess R is disposed between the first guiding slope 131 and the second guiding slope 132, and the normal position P is at the recess R. Herein for example, the recess R is a long recess. In another embodiment, the first guiding slope 131 and the second guiding slope 132 can be directly connected with each other, and the normal position P is disposed at the higher intersection between the first guiding slope 131 and the second guiding slope 132. In this embodiment, the first guiding slope 131 and the second guiding slope 132 can be disposed symmetrically. To be noted, by the rotation element 12 contacting the first guiding slope 131 or the second guiding slope 132 in a rolling contact manner, the friction and abrasion between the rotation element 12 and the first guiding slope 131 or the second guiding slope 132 can be reduced, so that the rotation element 12 can roll smoothly along the first guiding slope 131 or the second guiding slope 132 with an extended lifespan.

As shown in FIG. 3, when the pressure bar 11 is located at the state of the highest position (the outer tube 111 has the most degree of the extension in relation to the piston bar 119), the rotation element 12 is located at the normal position P, i.e. the higher intersection between the first guiding slope 131 and the second guiding slope 132. When the outer tube 111 descends in relation to the piston bar 119, the rotation element 12 will leave the resetting element 13 with the first guiding slope 131 or the second guiding slope 132 because the resetting element 13 doesn't descend. Moreover, when the user rotates the lifting chair 2, the rotation element 12 will depart from the normal position P in a perpendicular direction. Again, when the pressure bar 11 ascends to a certain height under the user's operation, the rotation element 12 will contact the first guiding slope 131 or the second guiding slope 132 one more time and is guided to the normal position P by the first guiding slope 131 or the second guiding slope 132. Thereby, many of the resettable pressure bar modules 1 of this embodiment can be aligned towards the same orientation due to the limitation of the normal position P. To be noted, in this embodiment, the piston bar 119, the rotation element 12 and the outer tube 111 have a synchronous rotation, so as to prevent the friction between the oil seal 1132 of the lower sealing element 113 and the piston bar 119 and further to avoid the air leakage.

The resettable pressure bar module 1 of this embodiment can further include a supporting tube 14. The resetting element 13 is disposed in the supporting tube 14 and fixed to the supporting tube 14, for example, by the engaging connection. The pressure bar 11 passes through the supporting tube 14 and is fixed to one end of the supporting tube 14. Herein, the piston bar 119 passes through the lower sealing element 113 and is fixed to a distal end of the supporting tube 14. Herein for example, a fixing element 15 is used for fixing the piston bar 119 to the distal end of the supporting tube 14, and a pad G is disposed between the fixing element 15 and the supporting tube 14 for enhancing the connection strength.

The following is the further illustration about the components of the resettable pressure bar module 1 with the operation process.

Figure 5:
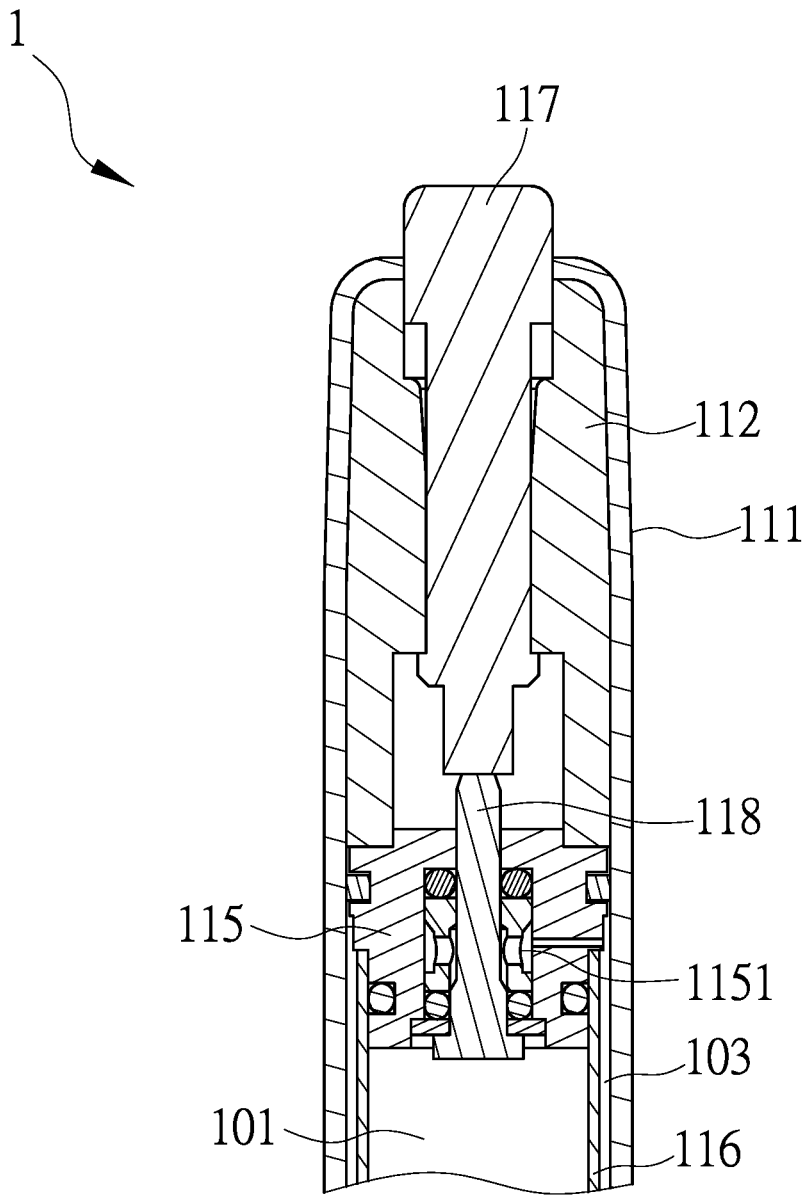
FIG. 5 is a schematic diagram of the portion of the resettable pressure bar module at the valve base of an embodiment of the invention.
Figure 6:
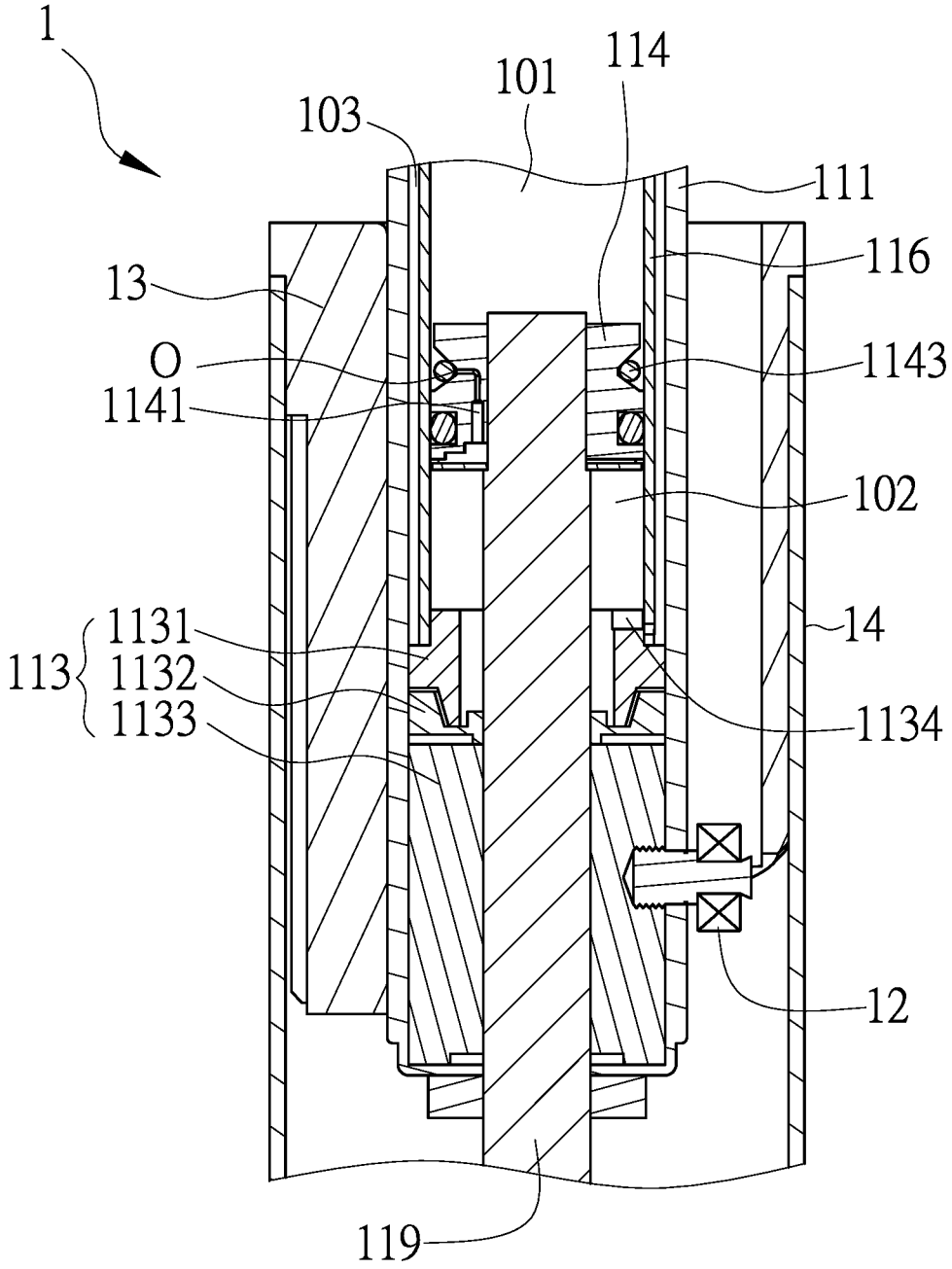
FIG. 6 is a schematic diagram of the portion of the resettable pressure bar module at the resetting element of an embodiment of the invention.

FIG. 5 is a schematic diagram of the portion of the resettable pressure bar module 1 at the valve base 115, and FIG. 6 is a schematic diagram of the portion of the resettable pressure bar module 1 at the resetting element 13. As shown in FIG. 5, the valve base 115 includes a first valve hole 1151, and between the outer tube 111 and the inner tube 116 forms an outer channel 103. As shown in FIG. 6, the lower sealing element 113 includes a second valve hole 1134, and the piston 114 includes an inner channel 1141 and a sealing ring 1143 which can open and close an upper opening O of the inner channel 1141. When the resettable pressure bar module 1 is under a first operation (the outer tube 111 descends in relation to the piston bar 119 for example), the air in the upper chamber 101 sequentially passes through the first valve hole 1151, the outer channel 103 and the second valve hole 1134 to flow to the lower chamber 102. When the resettable pressure bar module 1 is under a second operation, the air in the lower chamber 102 passes through the inner channel 1141 to flow to the upper chamber 101.

Figure 7:
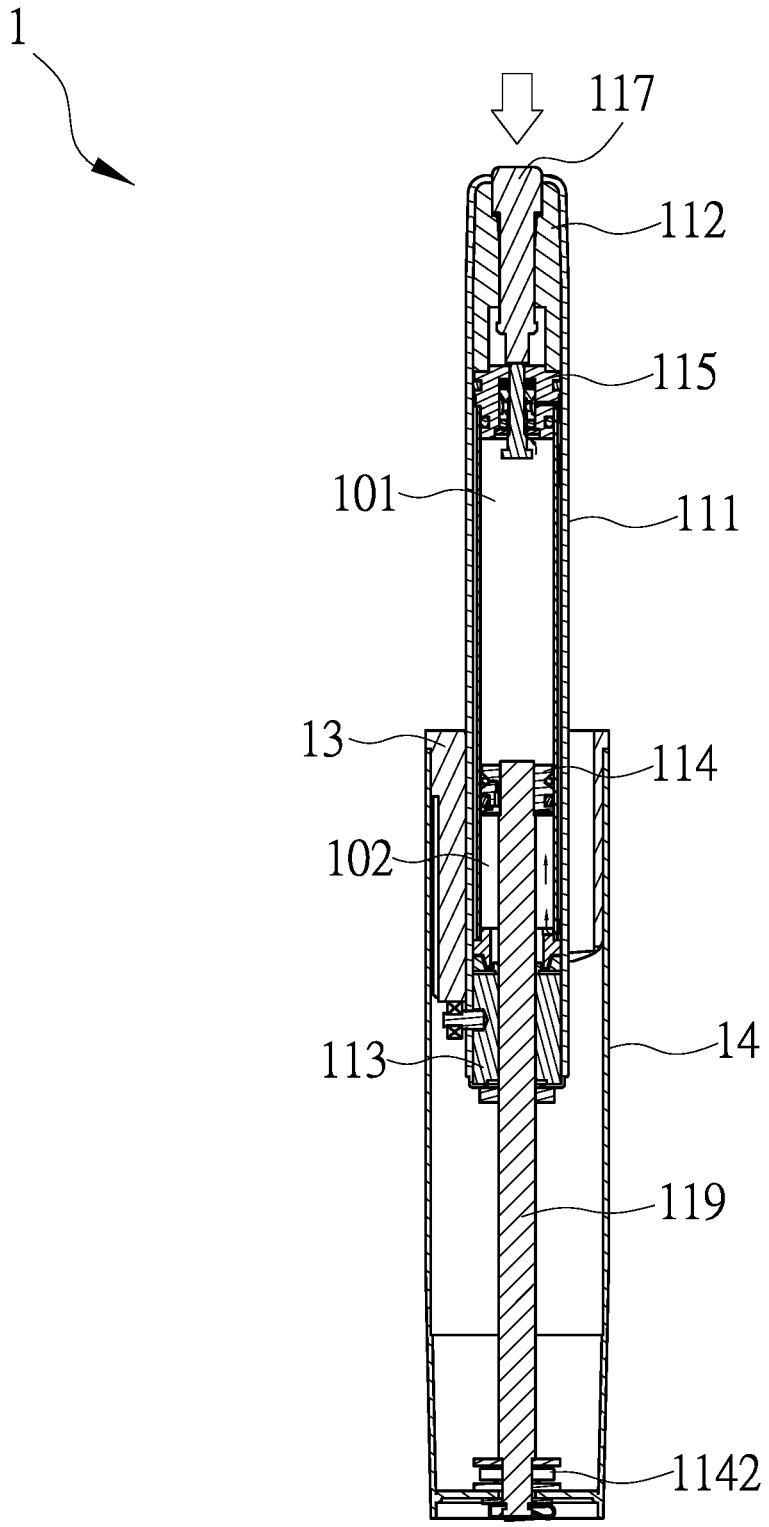
FIG. 7 is a schematic operation diagram of the resettable pressure bar module of an embodiment of the invention.
Figure 8:
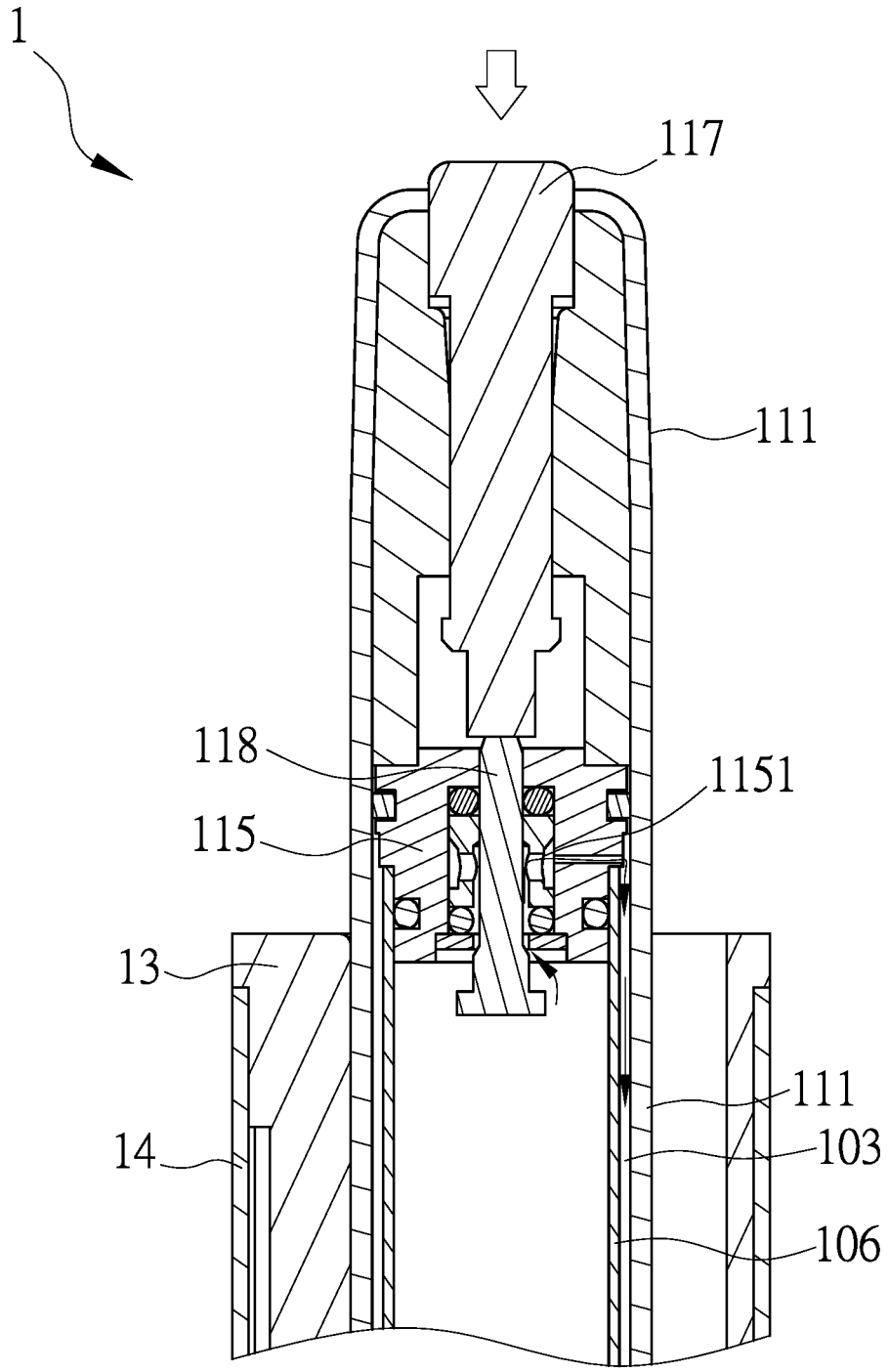
FIG. 8 is a schematic diagram of the air flowing at the upper chamber under the operation of FIG. 7.
Figure 9:
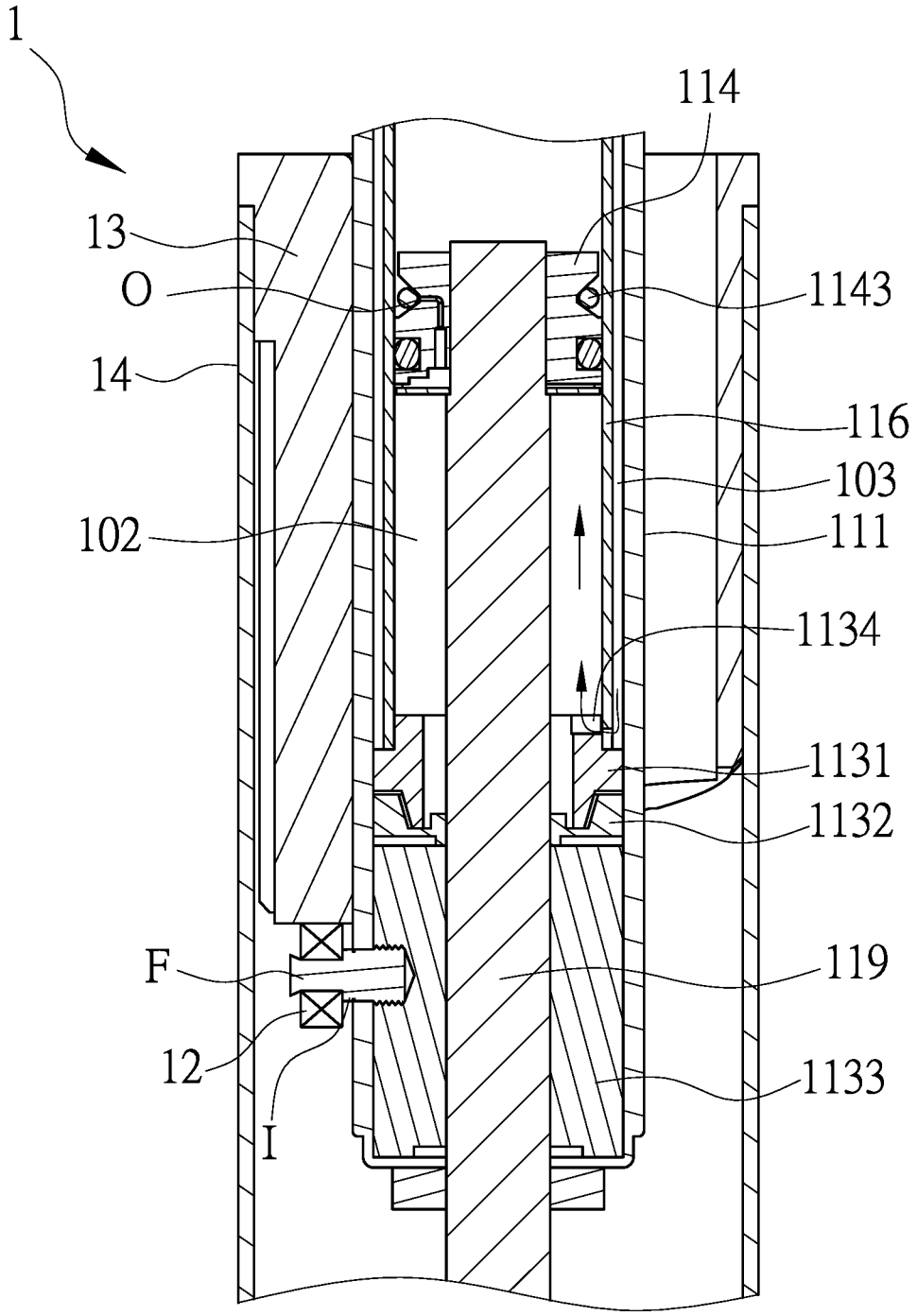
FIG. 9 is a schematic diagram of the air flowing at the lower chamber under the operation of FIG. 7.

FIG. 7 is a schematic operation diagram of the resettable pressure bar module 1 of an embodiment of the invention, FIG. 8 is a schematic diagram of the air flowing at the upper chamber 101 under the operation of FIG. 7, and FIG. 9 is a schematic diagram of the air flowing at the lower chamber 102 under the operation of FIG. 7. As shown in FIG. 7, for example wherein the resettable pressure bar module 1 is under the first operation (the outer tube 111 descends in relation to the piston bar 119 for example), the user operates the operation bar 22 of FIG. 1 to make the resettable pressure bar module 1 descend. Meanwhile, as shown in FIGS. 8 and 9, an air in the upper chamber 101 sequentially passes through the first valve hole 1151 of the valve base 115, the outer channel 103 and the second valve hole 1134 of the lower sealing element 113 to flow to the lower chamber 102. Besides, in the first operation, the rotation element 12 will go down to leave the resetting element 13 with the first guiding slope 131 or the second guiding slope 132.

Figure 10:
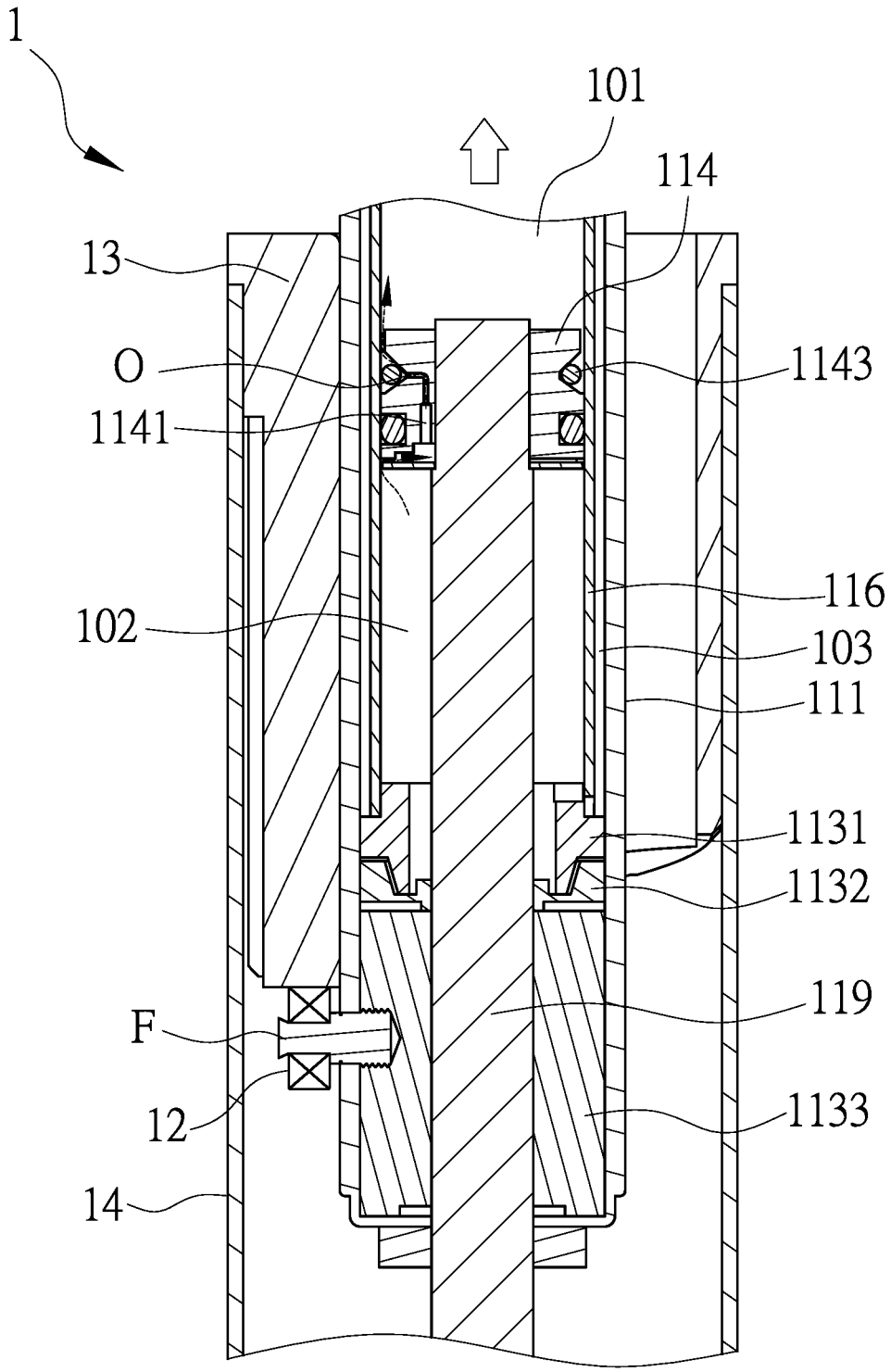
FIG. 10 is a schematic diagram of another operation of the resettable pressure bar module of an embodiment of the invention.

FIG. 10 is a schematic diagram of another operation of the resettable pressure bar module 1 of an embodiment of the invention. As shown in FIG. 10, when the user makes the resettable pressure bar module 1 under the second operation (the outer tube 111 ascends in relation to the piston bar 119) by leaving the chair or operating the operation bar 22, the air will push the piston 114 so that the sealing ring 1143 leaves the upper opening O of the inner channel 1141, and thus the air can flow from the lower chamber 102 to the upper chamber 101 through the inner channel 1141 of the piston 114. Meanwhile, the rotation element 12 will ascend, and when contacting the first guiding slope 131 or the second guiding slope 132, the rotation element 12 will be guided to the normal position P by the first guiding slope 131 or the second guiding slope 132. Thereby, many of the resettable pressure bar modules 1 of this embodiment can be aligned towards the same orientation due to the limitation of the normal position P.

Figure 11:
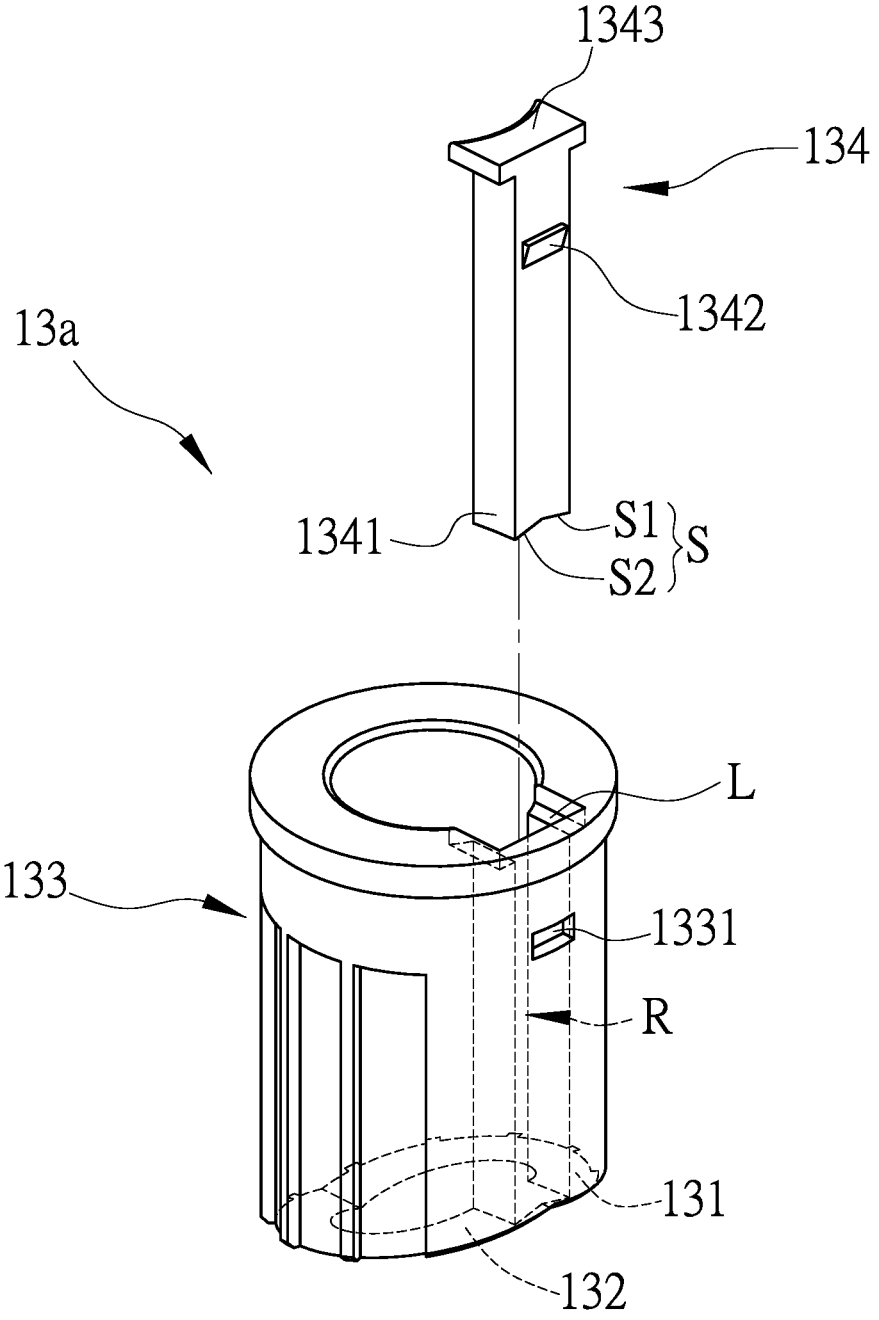
FIG. 11 is a schematic diagram of the resetting element having a vibration reducing portion of an embodiment of the invention.
Figure 12:
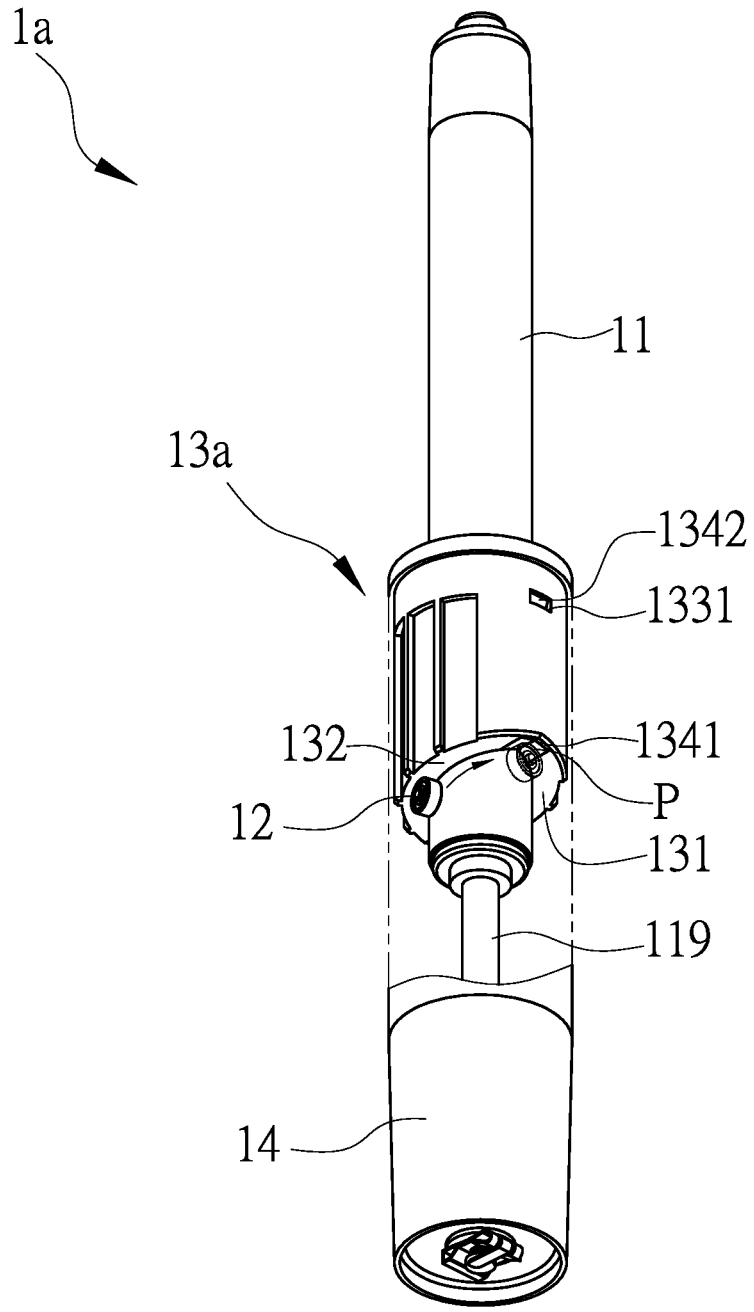
FIG. 12 is a schematic diagram of a rotation element of the resettable pressure bar module rotating on the resetting element of FIG. 11 of an embodiment of the invention.

Moreover, the resetting element of this invention can have different embodiments, which are illustrated for example by FIGS. 11 and 12. FIG. 11 is a schematic diagram of the resetting element having a vibration reducing portion of an embodiment of the invention, and FIG. 12 is a schematic diagram of the rotation element rotating on the resetting element of FIG. 11.

In this embodiment, the resetting element 13*a* includes a vibration reducing portion 1341 disposed between the first guiding slope 131 and the second guiding slope 132, and the normal position P is located at the vibration reducing portion 1341. In this embodiment, the vibration reducing portion 1341 includes a slope S1 connected with the first guiding slope 131 or the second guiding slope 132. Herein, the vibration reducing portion 1341 includes a vibration reducing surface S, and the vibration reducing surface S includes two slopes S1 and S2 connecting to each other. The slope S1 is connected with the first guiding slope 131, and the slope S2 is connected with the second guiding slope 132. A slope of the slope S1 is equal to that of the first guiding slope 131, and a slope of the slope S2 is equal to that of the second guiding slope 132. By the configuration of the vibration reducing portion 1341 and the vibration reducing surface S, the effects of buffer and resistance can be provided when the rotation element 12 moves to the normal position P through the first guiding slope 131 or the second guiding slope 132, thereby achieving the purpose of reducing vibration.

In other embodiments, a slope of the slope S1 may not be equal to that of the first guiding slope 131, and a slope of the slope S2 may not be equal to that of the second guiding slope 132. For example, the slope S1 is gentler than the first guiding slope 131 and the slope S2 is gentler than the second guiding slope 132, thereby achieving the buffer and resistance effect to achieve the purpose of reducing vibration. Moreover, in one embodiment, it also can be embodied that the first guiding slope 131 and the second guiding slope 132 are directly connected to each other to form a vibration reducing portion, which also can achieve the purpose of reducing vibration. To be noted, during the process of the rotation element 12 guided to the normal position P through the first guiding slope 131, the rotation element 12 may go too far to reach the second guiding slope 132 or the slope S2 and then come back to the normal position P, or may go too far again to reach the first guiding slope 131 or the slope S1 and then come back to the normal position P. This also shows that the rotation element 12 does get the effects of buffer and resistance.

In the practice, the resetting element 13 of this embodiment includes a guiding element 133 and a vibration reducing element 134. The guiding element 133 includes the first guiding slope 131 and the second guiding slope 132. The vibration reducing element 134 includes the vibration reducing portion 1341 and connects to the guiding element 133. The vibration reducing element 134 can connect to the guiding element 133 by engaging, locking, adhering or other connecting manners, and engaging is illustrated as an example here. In this embodiment, the vibration reducing element 134 includes an engaging portion 1342, and the guiding element 133 includes a corresponding engaging indentation 1331. The engaging portion 1342 and the engaging indentation 1331 can connect to each other to make the vibration reducing element 134 and the guiding element 133 engage with each other. In this embodiment, the guiding element 133 includes a recess R, which is illustrated as a long recess for example. The vibration reducing element 134 is inserted into the recess R to be connected with the guiding element 133, and they are fixed together by the engagement between the engaging portion 1342 and the engaging indentation 1331. Moreover, the thickness of the engaging portion 1342 is reduced gradually from a top portion 1343 of the vibration reducing element 134 to the vibration reducing portion 1341, thereby making the engaging portion 1342 easily be introduced into the engaging indentation 1331 in functionality.

In this embodiment, the vibration reducing element 134 can further include a top portion 1343. The top portion 1343 and the vibration reducing portion 1341 are respectively disposed on the opposite two ends of the vibration reducing element 134, and the top portion 1343 and the guiding element 133 are connected with each other by a ladder structure L. The disposition of the ladder structure L can enhance the connection strength between the vibration reducing element 134 and the guiding element 133, and can also provide the guiding and positioning effect for the vibration reducing element 134 so that it can be installed to the guiding element 133 more easily.

There may be some situations in the manufacturing process, and they are illustrated as below for reference.

After the injection molding, the resetting elements 13, 13*a* cannot have a real circular inner circumference so that it can't match the pressure bar 11 having a circle appearance. Therefore, in the manufacturing process, the resetting elements 13, 13*a* will be inserted into the supporting tube 14, and then be given the treatment to have a circular inner circumference. After that, the pressure bar 11 equipped with the rotation element 12 is inserted in, and the vibration reducing element 134 is then installed to the long recess R.

In the case without the long recess R, the assembly still can be performed (the pressure bar 11 equipped with the rotation element 12 is inserted into the resetting element 13 or 13*a* through the first and second guiding slopes 131, 132 with the push bar 117 inserted first, and then the whole set is inserted into the supporting tube 14). However, in the case without the long recess R, the plastic components of the pressure bar 11 will cause the tolerance due to the hot expansion and cold shrink, so that the rotation element 12 that has been installed to the pressure bar 11 may not contact the slopes S1, S2 of the vibration reducing element 134. Therefore, the vibration reducing elements with the slopes S1, S2 having different slopes will be manufactured in advance for the replacement. When the vibration reducing element 134 is installed to the long recess R and the two slopes S1, S2 can't contact the rotation element 12 at the normal state, it will be replaced by another vibration reducing element. Or, the measurement will be conducted before the installation of the vibration reducing element so as to adopt a proper vibration reducing element.

The resetting element 13, 13*a* after the injection molding has a smaller inner diameter than an outer diameter of the pressure bar 11. Therefore, after inserting the resetting element into the supporting tube 14 and before installing the pressure bar 11, the inner circumference of the resetting element is processed (the purpose has been illustrated as above), so that the pressure bar 11 and the inner circumference of the resetting element 13, 13*a* can have a better surface contact, thereby reducing the waver of the pressure bar 11 (especially for the portion of the pressure bar 11 protruding from the supporting tube 14) along the X-axis direction (perpendicular to the longitudinal axis)

In summary, a resettable pressure bar module according to the invention is configured with a rotation element and a resetting element. The rotation element is fixed to the outer tube of the pressure bar and the lower sealing element through a fixing element, and the resetting element at one side includes a first guiding slope and a second guiding slope. Thereby, in the case of that the resettable pressure bar module descends (or contracts) and rotates due to the user's operation, when the resettable pressure bar module ascends (or extends) again, the rotation element can contact the resetting element again and can be rotated to a normal position along the first guiding slope or the second guiding slope. Therefore, all the lifting devices using the resettable pressure bar module of the invention can be located at the normal position and aligned towards the same orientation for increasing the using efficiency.

Moreover, in this invention, the vibration reducing portion is disposed or the first guiding slope and the second guiding slope are directly connected with each other to form a vibration reducing portion. Therefore, when the rotation element rotates to the normal position along the first guiding slope or the second guiding slope, the whole vibration and waver can be reduced by the vibration reducing portion to enhance the using efficiency and the product competitiveness.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

The invention claimed is:

1. A resettable pressure bar module comprising:

a pressure bar including an outer tube, an upper sealing element and a lower sealing element, with the outer tube adapted to be fixed to a chair cushion and disposed in a supporting tube, wherein the upper sealing element and the lower sealing element are disposed in the outer tube and respectively disposed on opposite two sides of the outer tube, with the pressure bar further including a piston and a piston bar, with the piston disposed within the outer tube and located between the upper sealing element and the lower sealing element along a longitudinal axis of the outer tube, with the piston bar including a first end and a second end spaced from the first end along the longitudinal axis, with the first end of the piston bar passing through the lower sealing element and fixed to the piston in the outer tube, with the second end of the piston bar being outside of the outer tube and fixed to the supporting tube, wherein the outer tube is moveable relative to the piston bar along the longitudinal axis;

a rotation element fixed to the outer tube and the lower sealing element through a fixing element, with the rotation element disposed in the supporting tube and outside the outer tube; and a resetting element disposed in and fixed to the supporting tube, one side of which including a first guiding slope and a second guiding slope, wherein the outer tube of the pressure bar passes through the resetting element, and the rotation element is configured to rotate to a normal position along the first guiding slope or the second guiding slope, wherein the resetting element includes a guiding element and a vibration reducing element, with the guiding element including the first guiding slope and the second guiding slope, with the vibration reducing element including a vibration reducing portion located between the first guiding slope and the second guiding slope, with the normal position located at the vibration reducing portion, wherein the guiding element includes a recess, and the vibration reducing element is inserted into the recess to connect to the guiding element.

2. The resettable pressure bar module as recited in claim 1, wherein the vibration reducing portion includes two slopes connecting to each other, and the two slopes are connected to the first guiding slope and the second guiding slope, respectively.

3. The resettable pressure bar module as recited in claim 1, wherein the pressure bar further includes:

a valve base disposed in the outer tube and fixed to the upper sealing element;

an inner tube disposed in the outer tube and between the valve base and the lower sealing element;

a push bar disposed in the outer tube, with the push bar passing through the upper sealing element and exposed from the outer tube; and an operation bar passing through the valve base and contacting the push bar.

4. The resettable pressure bar module as recited in claim 3, wherein the valve base includes a first valve hole, the lower sealing element includes a second valve hole, the piston includes an inner channel and a sealing ring which is able to open and close an upper opening of the inner channel, and an outer channel forms between the outer tube and the inner tube.

5. The resettable pressure bar module as recited in claim 4, wherein the piston in the outer tube defines an upper chamber disposed near the upper sealing element and a lower chamber disposed near the lower sealing element, wherein when the resettable pressure bar module is under a first operation, an air flows from the upper chamber to the lower chamber sequentially through the first valve hole, the outer channel and the second valve hole, and when the resettable pressure bar module is under a second operation, the air flows from the lower chamber to the upper chamber through the inner channel.

* * * * *